United States Patent [19]

Keller

[11] 4,294,692

[45] Oct. 13, 1981

[54] DRUM-TYPE SCREENING MACHINE AND METHOD OF OPERATION

[75] Inventor: Alois Keller, Uzwil, Switzerland

[73] Assignee: Gebrueder Buehler AG, St. Gallen, Switzerland

[21] Appl. No.: 145,834

[22] Filed: May 1, 1980

Related U.S. Application Data

[60] Continuation of Ser. No. 934,022, Aug. 16, 1978, abandoned, which is a division of Ser. No. 873,896, Jan. 31, 1978, Pat. No. 4,222,864.

[30] Foreign Application Priority Data

Feb. 3, 1977 [CH] Switzerland ..... 1349/77

[51] Int. Cl.[3] ..... B07B 1/20; B07B 1/48

[52] U.S. Cl. ..... 209/300; 29/407; 29/446; 209/403; 209/407

[58] Field of Search ..... 209/293, 296, 298, 299, 209/300, 402–407, 411, 413; 85/1 T; 29/407, 446

[56] References Cited

U.S. PATENT DOCUMENTS

| | | | |
|---|---|---|---|
| 226,301 | 4/1880 | Gardner et al. | 209/406 |
| 265,428 | 10/1882 | Neander | 209/406 |
| 324,187 | 8/1885 | Teague | 209/406 |
| 387,057 | 7/1888 | Eldred | 209/299 |
| 480,345 | 8/1892 | Reinbold | 209/298 |
| 501,898 | 7/1893 | Schupp | 209/298 |
| 950,170 | 2/1910 | Goetz | 209/406 |
| 4,133,751 | 1/1979 | Stengal | 209/404 |

FOREIGN PATENT DOCUMENTS

| | | | |
|---|---|---|---|
| 2129952 | 2/1974 | Fed. Rep. of Germany | 209/406 |

*Primary Examiner*—Gregory N. Clements
*Attorney, Agent, or Firm*—Larson and Taylor

[57] ABSTRACT

A drum type screening machine has a centrifuging rotor within it. A perforated retaining element is carried by the shaft between a feed inlet and an entry region of the drum. Use of the retaining element prolongs the screen life so much that tension adjustment become necessary. Provision is made for this to be done from outside of the machine. The screening drum has a pair of rings which support the screening cloth and which are held apart at an adjustable distance by tensioning bars. One ring is supported within an end member of the machine housing and the other on support means within the housing. Each bar is externally threaded, e.g. by way of an extension sleeve that is axially fast with the bar. The sleeve is engaged by an internally threaded nut which is axially fast with the end member of the machine. The sleeve extends through that nut and through the end member to the outside of the machine. A hexagonal head formed on the end of the sleeve can be turned exteriorly of the machine with a box spanner, thereby to tension the screen cloth.

16 Claims, 11 Drawing Figures

DRUM-TYPE SCREENING MACHINE AND METHOD OF OPERATION

This is a continuation of application Ser. No. 934,022 filed Aug. 16, 1978, abandoned, which is in turn a division of Ser. No. 873,896, filed Jan. 31, 1978, now U.S. Pat. No. 4,222,864 issued on Sept. 16, 1980.

FIELD OF THE INVENTION

The invention relates to a drum-type screening machine having a tubular screening drum in which a centrifuging rotor is arranged.

Such drum-type screening machines are used very often for the shifting of fine products. In grain milling for example they are used for control sifting of the finished products, and have already been proposed as screening apparatus for individual passages.

In such cases, relatively fine screening cloths are used, which can very easily be damaged because of the centrifuging action by foreign bodies such as pieces of wood, metal, screws and the like.

The safety devices used hitherto have considerable disadvantages. A magnet can retain only magnetisable articles. A swing-out device before the machine involves a loss of product and also does not always operate reliably.

STATEMENT OF PRIOR ART

In a simple, slowly rotating screening drum for coarse products (French Pat. No. 1 371 955 of 1964) a screening tube of relatively small diameter and provided with coarse perforations is fixed coaxially on the screening drum. But such a screening tube requires a separate outlet, which involves great complication in the construction of the housing in the case of a drum-type screening machine for fine products, and makes it impossible to arrange a centrifuging rotor independent of the screening drum.

In an early proposal (German Pat. No. 33328 of 1885) grinding stock falls from the inlet of a screening machine into a screw conveyor and thence is conveyed to a basket having a conical portion of wire. Conveyor blades propel the grinding stock through the wire weave. A stop plate forms the bottom of the basket and has a conical flange which returns the grinding stock to the entry region of the screen. The basket collects larger foreign bodies and has room to store then clear of the conveyor blades. Access to the basket for removal of accumulated foreign bodies is difficult or impossible without major dismantling of the machine, there being a port in an end cover of the screen support, a closure to that part, and no means of access to that cover. Moreover the provision of a door for periodic removal of the foreign bodies would lead to construction problems in the vicinity of the main bearing.

SHORT DESCRIPTION OF THE INVENTION

The invention makes it possible to obviate these disadvantages in a surprisingly simple manner. The invention provides a drum type screening machine comprising a tubular screening drum, a shaft extending axially with respect to said drum, a centrifuging rotor mounted on said shaft for rotation within said drum, a feed inlet to said drum near an entry region of said drum, a perforate retaining element mounted on said shaft intermediate said feed inlet and said entry region, said screening drum having screening perforations and said retaining element having retaining perforations, said retaining perforations being larger than said screening perforations; and said retaining element having an access aperture therein and a movable closure element and means for holding said closure element movably in position to close said access aperture.

Of course the holes of the retaining element have smaller dimensions than the foreign bodies which have to be held back.

According to a further feature the retaining element can comprise a perforated plate for example a perforated metal plate or coarse screening cloth. Preferably dense perforation is provided, i.e. with a large free throughflow section. For easily flowing products e.g. flour and semolina, a hole diameter of about 2.5 mm is advisable. For poorly flowing mill products e.g. filter flour, a hole diameter of 4 mm is suitable. If the perforated plate is used by itself, a very simple construction is obtained which is quite satisfactory for straightforward uses. But it has the disadvantages that the retained foreign bodies tumble about in the machine housing and cause wear therein. When there are large foreign bodies to be dealt with, the shape-closing accuracy of the disc is not guaranteed, since the disc can fairly easily be damaged.

Therefore, it is advisable to secure on the perforated plate a rim which extends in the direction of the inlet and which forms, together with the perforated plate, a basket. Because of the centrifuging effect, the foreign bodies remain lying on the rim, and there is no relative movement with regard to the basket. Thus, the wear and damage problems are solved.

It is advantageous also to perforate the rim, so that at the end of a working period the basket can be completely emptied by rotational movement of the centrifuging motor. Since the rim is at a small spacing from the housing of the machine and from the screen fabric, during operation the perforations are able to allow a continual flow of fresh product through the narrow annular gap.

If the retaining is secured by spokes on the shaft of the centrifuging rotor, and if the spokes are secured preferably on a hub, which itself is secured to the shaft, simple constructions are obtained. The spokes may, at least in part, be inclined relatively to the alignment of the centrifuging rotor and be constructed as feed or conveying blades.

If the perforated plate is arranged at an inclination to the axis of the centrifuging rotor to act as a kind of swash plate, the product is pulsed to and fro at the disc, which improves the transfer to the screen chamber. This also applies if the rim of the basket is conical in shape.

A simple construction is obtained if the closure element is a movable segment. The segment can be arranged to be axially displaceable at the inlet side of the perforated plate, and could be secured to a hub adapted to be displaced on the shaft of the centrifuging rotor. A compression spring can be provided between the fixed hub of the retaining element and the displaceable hub of the segment, for pressing the segment towards the perforated plate.

If locating pins to locate the sides of the segment are secured on the retaining element, the locating pins being shorter than the opening travel of the segment, the segment can be displaced first and then turned, which facilitates the removal of the foreign bodies.

The spokes can be formed with recesses in order to allow the displacement of the segment.

Hitherto the normal working life of the screening cloth has not been fully utilised, since it is usually damaged by foreign bodies before it wears out. This kind of damage is obviated when using the drum-type screening machine provided by the invention. But as a result of the normal wear on the screening cloth, which will now be experienced, the tension of the screening cloth will vary and this will considerably modify the screening effect. Therefore, it is necessary to be able to modify the tension of the screening cloth quickly. In a known drum-type screening machine (German Pat. No. 2 129 952) its screening drum is provided with a screening cloth which can be arranged on two rings which are connected by bars to be at an adjustable distance apart, the first ring can be fixed to a closure part e.g. a cover which itself can be secured on the housing of the machine, the second ring being arranged to be slidable on a ring on the housing, and in the region of the closure part the bars are each provided with a screwthread. The screening drum can be removed relatively quickly and comfortably from the housing of the drum-type screening machine, and the screen tension can then be modified relatively easily. But this required a series of operations and the working of the machine is interrupted. It is possible to obviate these disadvantages, according to a feature of the invention, by providing the screening drum with an axially effective tensioning device which in the fitted state of the screening drum can be adjusted from the outside during operation.

Thus the invention also provides a drum type screening machine having a tubular screening drum, said drum comprising a first ring and a second ring and a screening cloth supported thereby and a plurality of tensioning bars holding said rings at an adjustable distance from each other, and said machine having a machine housing, a housing end member, said first ring being supported within said end member, support means within said housing adapted to support said second ring, each said bar having a first screwthread means at an end portion thereof, second screw thread means on one of said rings fast against axial movement relative to said one of said rings, said first and second screw thread means being in operative screw engagement, and turning means to cause relative rotation between said first and second screw means thereby to vary the distance between said rings.

In a particularly advantageous constructional form said first screw thread means on said bar is an exterior male thread and said second screw thread means is an internal female thread in a nut and said nut is captive with said one of said rings, the nut being in a fixed axial position relatively to the housing of the machine in the completely assembled state. Thus the position of the bars and thus the tension of the screening cloth can be modified during operation.

The simplest construction is obtained if the nut is fast against rotation in the completely assembled state. Advantageously the nut is provided with an external screwthread which can be screwed into a screwthreaded bore, the axial position of which is defined by the closure part. The screwthreaded bore is preferably arranged in the first ring itself or in a flange secured to the first ring. The nut can be of simple construction, consisting of a sleeve, having the external screwthread and of a head on the said sleeve, said head being provided with an engagement surface and being situated at the internal side of the machine. The sleeve can project outside the machine to receive a locknut, thereby guarding against turning movement.

If the bar is arranged on the second ring to be rotatable but axially fixed and is provided outside of the closure part with an engagement surface e.g. a hexagon, the tension of the screening cloth can be adjusted from the outside. But it is a better construction if the screwthread is situated on a screwthreaded sleeve which is rotatable but axially fixed on the bar, the bar being fixed fast against rotation. To achieve this, the bar can be screwed into the second ring or into a flange secured on the second ring, and secured by a locknut arranged at the inside.

The screwthreaded sleeve can advantageously be provided with an engagement surface, e.g. a hexagon portion.

If the equipment of the drum-type screening machine comprises a tubular hexagonal box spanner for turning the engagement surface, and is provided with a slot and a scale, the axial position of the engagement surface can be monitored so that all the bars can be adjusted equally.

If elastic buffer or cushion elements for the screening cloth are carried on the bars outside the screening drum, the pulsation of the screening cloth which takes place because of the centrifuging action can be influenced. Where individual buffer elements abut on the screening cloth the free vibration length is permanently reduced. Where individual buffer elements are spaced from the screening cloth, the free vibration length is reduced only when the buffer elements abut the cloth. To render the action of the buffer elements more specific, the screening cloth can be provided with a supporting hoop, preferably internally, in an axial position which corresponds to that of the buffer element in question.

BRIEF DESCRIPTION OF THE DRAWINGS

The invention will be explained with reference to the embodiment and two modifications thereof shown in the drawings wherein.

DESCRIPTION OF THE PREFERRED EMBODIMENT

Figure 1:
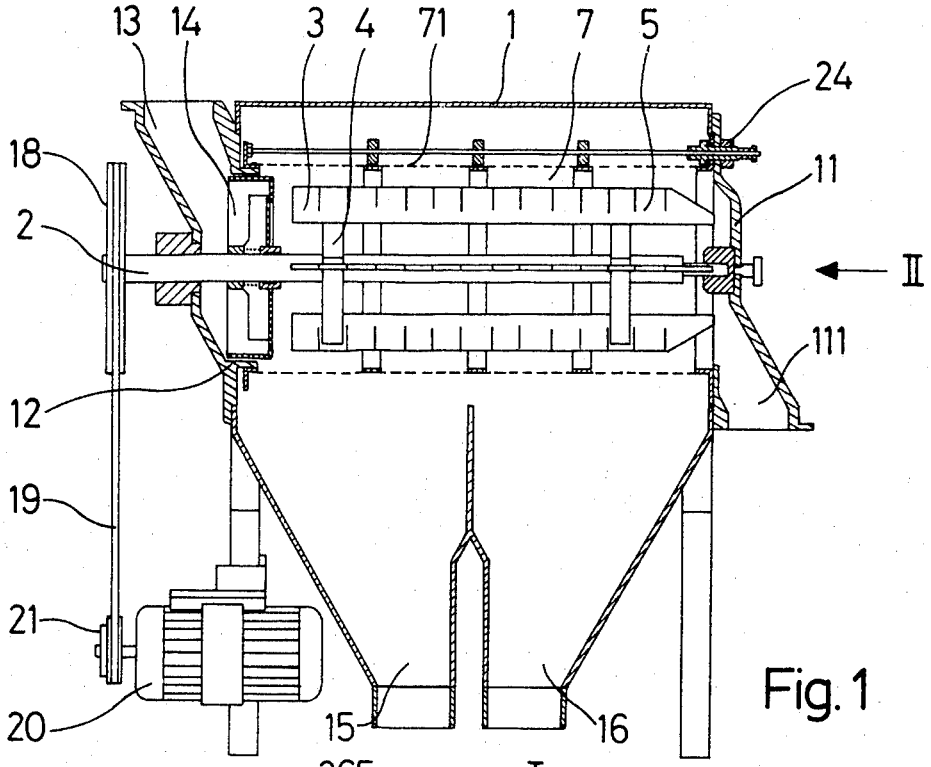
FIG. 1 shows the machine in longitudinal section taken on the line I—I of FIG. 2.
Figure 2:
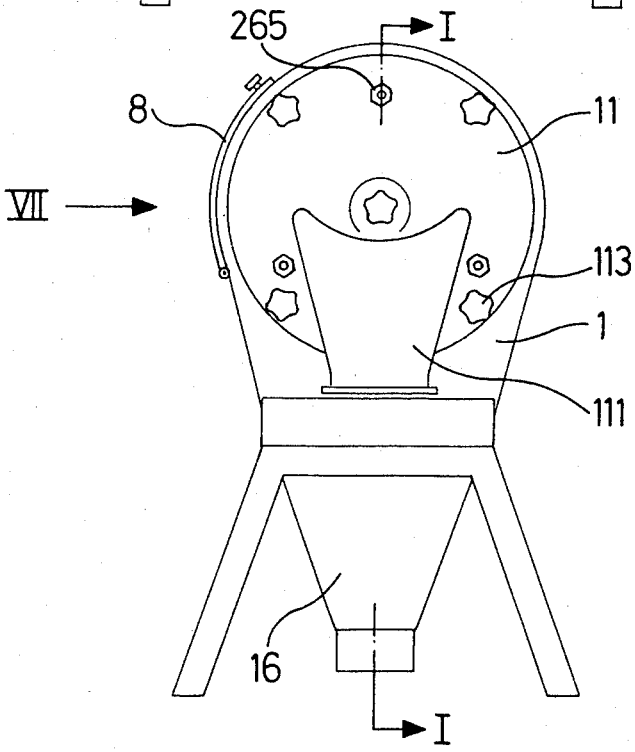
FIG. 2 is a side view as seen from the outlet side in the direction of the arrow II in FIG. 1.

In a drum type screening machine, a shaft 2 of a centrifuging rotor 3 is mounted in a housing 1 (FIGS. 1, 2). Arms 4 which carry blades 5 are secured on the shaft 2.

The centrifuging rotor 3 is arranged within a tubular screening drum 7 which is connected securely at one of its ends by means of a tensioning device 24 to an end member in the form of a closure cover 11 and at the other end is supported on a housing ring 12 of the housing 1. The blades 5 extend into the vicinity of the screening drum 7.

The housing 1 is provided with an inlet union 13. The inlet union 13 ends at a perforated retaining element 14 which is secured on the shaft 2. The housing 1 is also provided with fines discharge hoppers 15 and 16 for the fine products that pass through. A belt pulley 18 is secured on the shaft 2 of the centrifuging rotor 3. The belt pulley 18 is driven by means of the belt 19 by an electric motor 20 whose shaft end carries a belt pulley 21.

The product to be screened, e.g. grinding stock passes through the inlet union 13, through the perforated retaining element 14, into the screening drum 7 and is conveyed in the direction towards the closure cover 11 by the blades 5 which are shaped in known manner. The retaining element 14 holds back foreign bodies and allows the product to be screened to pass through. The finer particles fall through the covering (screening cloth) 71 of the screening drum 7 and are discharged by way of the discharge hoppers 15 and 16. The large particles are conveyed into the coarse outlet hopper 111 in the closure cover 11.

The perforated retaining element 14 (FIGS. 3,4,5,6) has the task of holding back foreign bodies which could damage the covering 71 of the screening drum 7. In order to be able to carry out this task without the retained foreign bodies tumbling about in the inlet union 13 of the housing 1, the retaining element 14 is constructed as a perforated basket 141 and provided with perforations 144.

The basket 141 has a perforated plate 135 to which a perforated rim 136 is secured projecting in the direction of the inlet. It is supported by means of spokes 142 on a hub 143 and is connected securely thereto. The hub 143 itself is mounted on the shaft 2 and is secured both axially and radially on the latter. The diameter of the basket 141 is so adapted to the housing ring 12 that an annular gap 145 is formed which is smaller than the diameter of a perforation 144. Entry of foreign bodies into the screening drum 7 is thereby prevented, and the foreign bodies are held in the basket 141 securely in a stationary position by reason of centrifugal force when the machine is running.

To improve product throughflow the spokes 142 are so constructed that the lines of attachment 148 and 149 on the hub 143 and basket 141 are inclined relatively to one another, so that a conveying effect is obtained: the spokes 142 are situated at an inclination relatively to the axial direction of the centrifuging rotor 3 and act as conveying blades.

To remove the foreign bodies the basket 141 is provided with a large aperture 150 which makes it possible when the machine is stopped to reach into the basket 141 through a laterally arranged housing cover 8 (FIG. 2) and take out the foreign bodies. For this purpose the screening drum 7 with the closure cover 11 must be moved out of the machine housing.

The aperture 150 in the basket 141 is covered during operation by a movable closure element 151. The closure element is half-moon or segment-shaped. It has the same perforations 144 as the basket 141 and is connected securely to a hub constructed as a sleeve 152. The sleeve 152 itself is mounted on the shaft 2 of the centrifuging rotor to be free to turn and displaced axially. The closure element 151 is held in position by a compression spring 153 which at one end presses against the sleeve 152 and at the other end bears against the hub 143 and thus presses the closure element 151 against the edges of the aperture 150.

The closure element 151 is secured against radial turning movement by locating pins 154 which are fixed at suitable places on the basket 141 from which they project to rather more than the extent of the thickness of the closure element 151.

To remove foreign bodies with the machine stopped, pressure is applied from the outlet side against the sleeve 152 and the closure element 151 and thus the force of the compression spring 153 is overcome.

As a result the closure element 151 is displaced axially and pressed out of the region of the locating pins 154. The locating pins being cleared, the closure element 151 can be turned relatively to the basket 141 and thus frees the aperture 150. The foreign bodies can easily be removed. In order to allow the axial opening travel of the closure element 151 the spokes 142 which support the basket 141 are provided with cut outs 146. The locating pins 154 are shorter than this opening travel.

Figure 3:
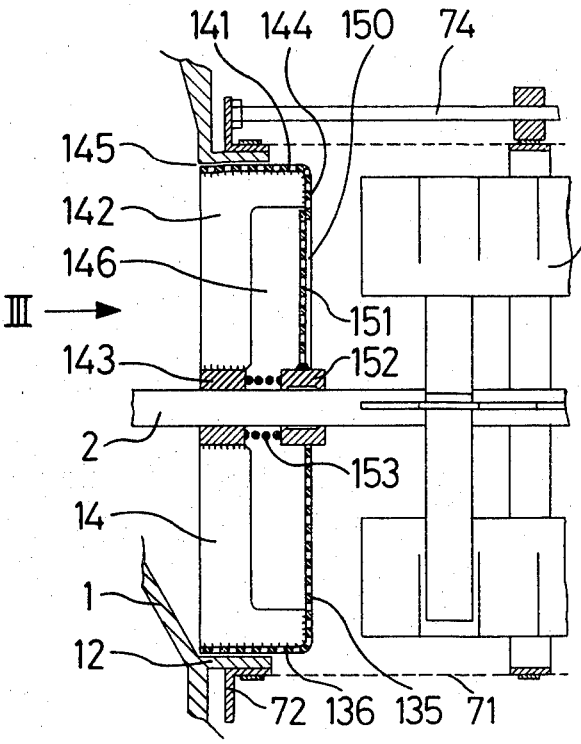
FIG. 3 shows a section on a larger scale through the inlet portion of the machine along the I—I of FIG. 2 and shows the retaining element and the inlet-region of the centrifuging rotor and of the screening drum.
Figure 4:
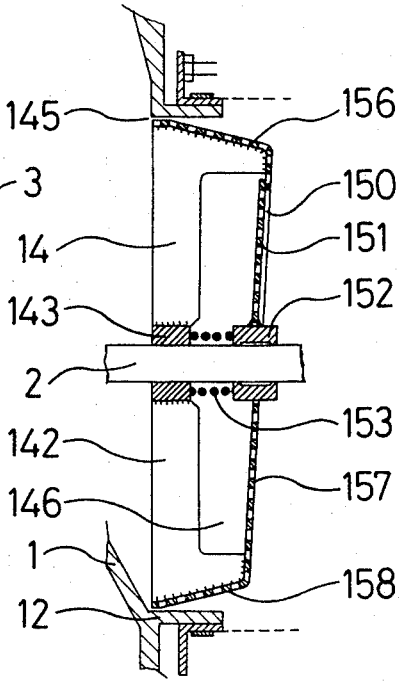
FIG. 4 shows a section through a modified form of retaining element on the same scale as in FIG. 3 along the line I—I of FIG. 2.
Figure 5:
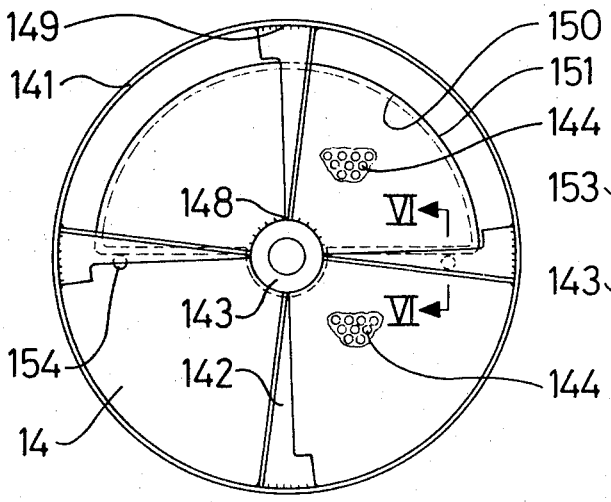
FIG. 5 is an end view of the retaining element of FIG. 3 seen in the direction of the arrow III in FIG. 3.
Figure 6:
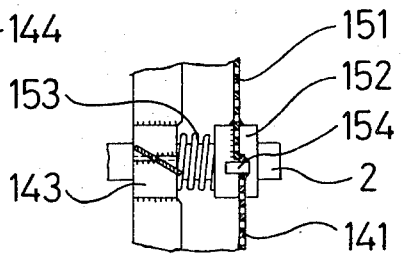
FIG. 6 shows a detail of the retaining element of FIG. 5 in section along the line VI—VI in FIG. 5.
Figure 7:
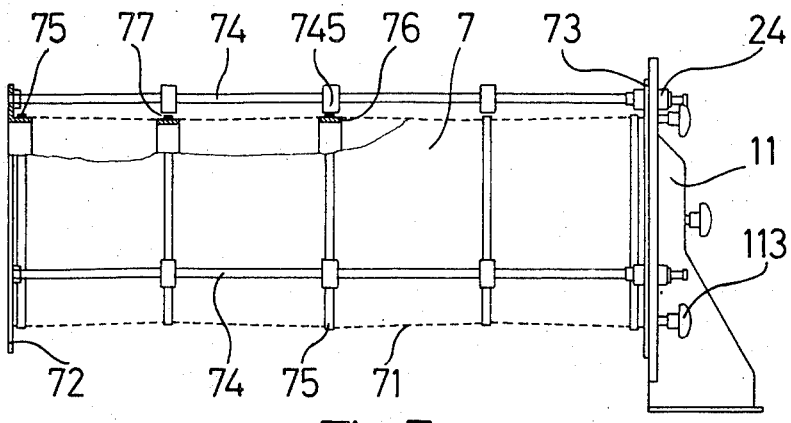
FIG. 7 is a view of the screening drum connected with the closure cover of the machine seen in the direction of the arrow VII in FIG. 2 but omitting the machine housing.

In the modification shown in FIG. 4 the function is substantially like that of the retaining element 14 shown in FIG. 3. But in this case the basket 156 is so constructed that a perforated plate 157 is at an inclination to the axis of the shaft 2 of the centrifuging rotor 3 and as a result a swash plate wobble disc effect is obtained. The rim 158 of the basket 156 is also conically shaped.

Because of the longer working life which can be expected from the covering 71 of the screening drum 7 it is necessary to arrange for this to be tightenable and loosenable i.e. for its tension to be adjustable. This is effected by a tensioning device 24 (FIGS. 7, 8, 9, 10, 11). As a support for the covering 71 (screening cloth) there is provided at the inlet side a flange ring 72 and at the outlet side a clamping ring 73 which is connected to the closure cover 11 by the tensioning device 24.

The flange ring 72 and the clamping ring 73 are spaced apart by tensioning bars 74. The covering is fixed both on the clamping ring 73 and also on the flange ring 72 by means of expander clips 75.

Figure 8:
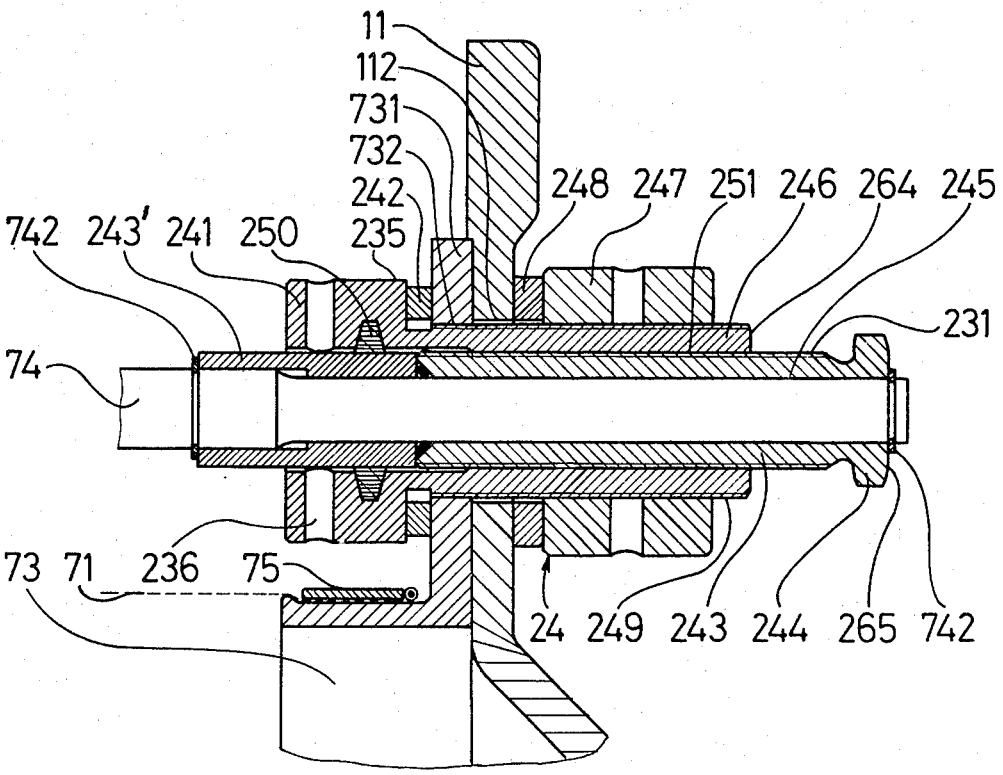
FIG. 8 is a section drawn to a larger scale through the region of fastening between screening drum and closure cover seen along the line I—I in FIG. 2, but showing only the upper portion of the closure cover with the neighbouring portion of the screening drum.
Figure 9:
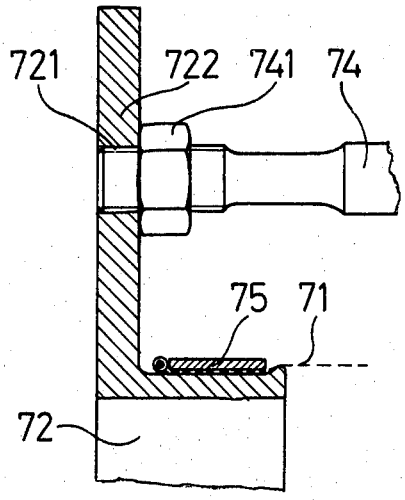
FIG. 9 is a section to the same scale as FIG. 8 taken along the line I—I of FIG. 2 showing the attachment of the bar to the second ring of the screening drum, again showing only the neighbouring portion.

In the constructional form shown in FIGS. 8, 9 the bars 74 are screwed into corresponding screwthreaded holes 721 (FIG. 9) in the flange 722 of the flange ring 72, and secured with a locknut 741 i.e. connected securely and fixedly to the flange ring 72.

Near the clamping ring 73 the bars 74 are connected to the housing 1 by means of the tensioning device 24 passing through holes 112 in the closure cover 11.

In order to loosen or tighten the covering 71, the bars 74 can be displaced in an axial direction relatively to the closure cover 11 by means of the tensioning device 24. Three tensioning devices are arranged on the periphery.

At the flange portion 731 of the clamping ring 73 there are arranged screwthreaded holes 732 into which nuts 241 are screwed. The nuts 241 are screwed on the clamping ring 73 with interposition of a shim 242 until abutment is reached, and thus connected to the clamping ring 73 so as to be fast against rotation therewith.

Screwed into the nut 241 is a screwthreaded sleeve 243 having an external screwthread 231. This screwthreaded sleeve 243 is provided at the outside of the machine with a hexagonal head 244. The screwthreaded sleeve 243 also has a bore 245 which is used for receiving the bar 74. The bar 74 is secured axially relatively to the screwthreaded sleeve 243 and the extension sleeve 243+ thereof by two fixing rings 742, e.g. circlips. To seal off the interior of the machine, the screwed connection between the nut 241 and the screwthreaded sleeve 243 is protected by a felt ring sealing element 250.

The entire screening drum 7 forms one unit, with the flange ring 72 and the clamping ring 73 being spaced apart by the bars 74, and the clamping devices 24 and also the covering 71 extending between the rings 72 and 73. Tightening or loosening of the covering 71 is possible in this condition by turning the screwthreaded sleeves 243.

The nuts 241 consist of a sleeve 246 and a head 235. The head is provided with an engagement surface formed of a transverse bore 236. The sleeve 246 projects so far beyond the flange portion 731 of the clamping ring 73 that the length is sufficient to secure the closure cover 11 thereon with a lock-nut 247 and shim 248. The holes 112 are provided for this purpose on the closure cover 11 for receiving the nut sleeve 246. The sleeve 246 is provided with an external screwthread 249 which matches the locknut 247. The head 235 faces the interior of the machine.

When the screening drum 7 is screwed to the closure cover 11 the entire unit can be moved into the housing 1 and the closure cover 11 connected to the housing 1 by means of screw bolts 113. The tensioning device 24 also projects from the closure cover 11 in the assembled state and is accessible from the outside.

For uniform tightening of the covering 71 a key 26 (FIG. 11) in the form of a box spanner is provided, consisting of a hexagon tube 261 having a slot 262 at the front. A scale 263 is along the length of the slot 262. For adjustment of the covering 71, the key 26 is fitted over the hexagon head 244 until it abuts the face 264. Turning of the key 26 with a tommy bar or pin 266 inserted through a hole 267 at the end of the hexagon tube 266, screws the screwthreaded sleeve 243 in or out and thus tightens or slackens the covering 71.

The degree of tightening of the covering 71 can be read off by observing the position of the screwthreaded sleeve edge 265 in relation to the scale 263 of the key 26. Uniform adjustment of the degree of tension of the covering 71 is thus possible from the outside of the machine during operation. This construction also affords the advantage that a completely fitted-up screening drum 7 can be prepared outside the machine with the correct tension in the covering 71 without the machine having to be stopped. If the screening drum 7 is to be replaced the old drum 7 can be dismantled from the cover 11 very quickly by releasing the locknuts 247, and a new drum 7 fitted in position again in the same way. As a result shut down times during which the machine has to be inoperative are very considerably shortened.

Figure 10:
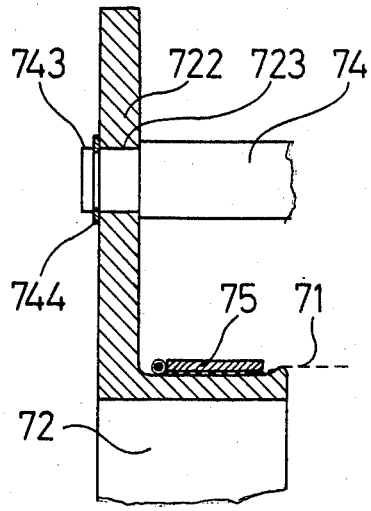
FIG. 10 illustrates a modification of the bar fastening arrangement on the second ring of the screening drum, corresponding to FIG. 9.
Figure 11:
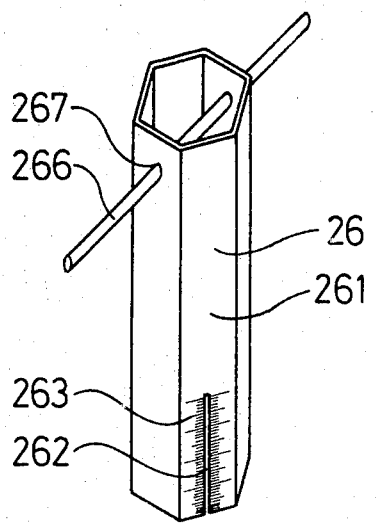
FIG. 11 shows a view of the hexagon box spanner with slot and scale, for use in screen tensioning.

A simpler constructional modification is also possible (FIG. 10). The bars 74 are provided at the region of the flange ring 72 with a shaped portion 743. The flange ring 72 has a number of holes 723 at the periphery corresponding to the number of bars. The bar 74 is secured axially in the flange ring 72 by means of a circlip 744. There is thus obtained a connection between bar 74 and flange ring 72 which is free in rotation but axially fast. In the region of the clamping ring (not separately illustrated) the bar 74 is provided with an external srewthread which fits directly into the screwthread 251 of the nut 241. The bar 74 projects beyond the nut sleeve 246 and is provided outside the machine with an engagement surface, e.g. a hexagonal head. By turning the bar 74 with a key 26 the covering 71 is also tightened or loosened from outside the machine.

To reduce the free vibration length of the covering 71 elastic buffer elements 745 (FIG. 7) can be provided on the bars 74. Internally of the covering 71 a support hoop 76 is mounted, corresponding axially to the position of the buffer element 745, and secured with the expander clip 75. The diameter of the buffer element 745 can be so chosen that it abuts on the expander clip 75, or an air gap 77 is formed between the buffer element 745 and the expander clip 75. With this apparatus and with suitable choice of the number of buffer elements 745 and support hoops 76, distributed along the length of the covering 71, the pulsation of the covering 71 can be influenced to suit the particular product and the length of the machine.

I claim:

1. A method of operating a drum type separator of the type having a stationary tubular screen, opposed support means for supporting the screen at opposite ends thereof and a rotor for causing movement of ground stock to be filtered, comprising the steps of:

supplying ground stock to be sieved through an inlet opening to the interior of the tubular screen while operating the rotor to cause movement of the ground stock such that the finer product passes through the stationary tubular screen and through a first outlet while the coarser product passes out a second outlet without having passed through the tubular screen, and, while the rotor is rotating and while product is being delivered to and through the separator, operating an adjusting means accessible exteriorly of the separator to vary the distance between the opposed support means to vary the tension of the tubular screen, one of the opposed support means being fixed axially and the other being axially moveable in either direction, and wherein the step of operating the adjusting means includes turning a turning means at one end of the drum to move the axially moveable support means axially in one direction or the other relative to the fixed support means.

2. A method according to claim 1, wherein the adjusting means is located at the end of the drum at which the fixed support means is located and the step of operating the adjusting means comprises effecting axial movement of the axially moveable support means located at the opposite end of the drum.

3. Drum type screening machine having a tubular screening drum; inlet means for delivering material to be screened into said drum, first outlet means for the material which passes through the screen, and second outlet means for material which does not pass through the screen, said drum comprising a first ring and a second ring and a screening cloth supported thereby and a plurality of tensioning bars holding said rings at an adjustable distance from each other; and said machine further having a non-rotational machine housing with an end opening, and a housing end member for closing that end opening, the housing and said housing end member together enclosing said drum; said drum, rings, tensioning bars, and said housing end member being fixed against rotation relative to the housing; said first ring being supported by said housing end member and fixed to it; and said machine further having support means within said housing supporting said second ring so as to be axially movable relative to said support means; each said bar having first screw thread means at an end portion thereof; second screw thread means at a fixed position relative to one of the rings and at the same end of drum as said first screw thread means; said first and second screw thread means being in operative screw engagement; whereby relative rotation between said first and second screw thread means axially displaces said tension bar relative to said one of said rings and axially displaces said second ring relative to said first ring; and turning means accessible at the exterior of the machine for effecting relative turning movement between the first and second screw thread means from the exterior of the machine, without disassembling the machine, to cause such rotation to vary the distance between said rings in either axial direction while the machine is in operation.

4. Machine as claimed in claim 3 wherein said first screw thread means on said bar is an exterior male thread, said first ring includes a nut for each said bar, and said second screw thread means in an internal female thread in said nut, and said nut is in an axially fixed position with respect to said one of said rings.

5. Machine as claimed in claim 4 comprising means for holding an end portion of said bar freely rotatable but axially fixed to said second ring, and said nut is fast against rotation with said first ring.

6. Machine as claimed in claim 5 wherein said bar has a portion that extends exteriorly of said housing end member, said bar portion being provided with an engagement surface for turning said bar.

7. Machine as claimed in claim 4 wherein said nut is in an axially fixed position with respect to said first ring, said nut comprising an externally threaded sleeve, said housing end member comprising an internal bore axially positioned with respect to said housing end member, and said externally threaded sleeve being inoperative screwed engagement relative to said internally threaded bore.

8. Machine as claimed in claim 7 wherein said externally threaded sleeve has an enlarged head disposed interiorly of the machine and said head has an engagement surface.

9. Machine as claimed in claim 8 wherein said sleeve projects exteriorly of said housing end member and there receives a lock nut.

10. Machine as claimed in claim 4 wherein said exterior male thread is provided on said bar by way of an extension sleeve, said extension sleeve being rotatable but axially fixed with respect to said bar and said bar being rotationally and axially fast with said second ring.

11. Machine as claimed in claim 10 wherein said extension sleeve has a portion that extends exteriorly of said housing end member, said extension portion being provided with an engagement surface for turning said extension sleeve.

12. Machine as claimed in claim 11 wherein said engagement surface is a hexagonal head, in combination with a hexagonal box spanner for adjustment of said head, the box of said spanner having an elongate observation opening in a side thereof and a scale near that opening for observing the extent of the penetration of said head into said spanner for consistency of setting of said plurality of tensioning bars.

13. Machine as claimed in claim 3, said machine comprising buffer elements for cushioning said screening cloth, said buffer elements being carried exteriorly of said drum by said tensioning bars.

14. Machine as claimed in claim 13 wherein at least some of said buffer elements are arranged to be in abutment with said screening cloth under steady condition of said screening cloth.

15. Machine as claimed in claim 13 wherein at least some of said buffer elements are arranged to be spaced from said screening cloth under steady conditions of said screening cloth.

16. Machine as claimed in claim 13 comprising support hoops, said hoops being mounted coaxially with said drum within said screen cloth and at locations axially in register with said buffer elements there to support said screen cloth.

* * * * *